US005365707A

United States Patent [19]

Jones et al.

[11] Patent Number: 5,365,707

[45] Date of Patent: Nov. 22, 1994

[54] ARCHITECTURAL ELEMENT FOR ATTACHING TO A STRUCTURE

[75] Inventors: Dale C. Jones; Michael A. Lacy, both of Conyers, Ga.

[73] Assignee: Vantage Products Corporation, Conyers, Ga.

[21] Appl. No.: 979,566

[22] Filed: Nov. 20, 1992

[51] Int. Cl.[5] ..... E06B 1/04

[52] U.S. Cl. ..... 52/211; 52/473; 52/204.53; 52/213

[58] Field of Search ..... 52/204.53, 211, 202, 52/213, 204.55, 473; 454/196, 224

[56] References Cited

U.S. PATENT DOCUMENTS

| | | | |
|---|---|---|---|
| 2,710,431 | 6/1955 | Griffon | 52/211 |
| 2,752,844 | 7/1956 | Simblest | 98/121 |
| 4,389,824 | 6/1983 | Anderson | 52/211 |
| 4,407,100 | 10/1983 | Huelsekopf | 52/212 |
| 4,473,981 | 10/1984 | Simpson | 52/204.53 |
| 4,780,998 | 11/1988 | Knapp | 52/204.53 |
| 4,875,317 | 10/1989 | Logan et al. | 52/208 |
| 4,875,318 | 10/1989 | MacLeod et al. | 52/211 |
| 4,892,322 | 1/1990 | Koza et al. | 277/207 R |
| 4,899,647 | 2/1990 | Garries et al. | 98/121.1 |
| 4,911,066 | 3/1990 | Carew | 52/473 X |
| 5,007,219 | 4/1991 | Sayer | 52/204.55 |
| 5,018,325 | 5/1991 | Geen | 52/211 |
| 5,018,330 | 5/1991 | Lewkowitz | 52/455 |

*Primary Examiner*—Carl D. Friedman
*Assistant Examiner*—Beth A. Aubrey
*Attorney, Agent, or Firm*—Seidel, Gonda, Lavorgna & Monaco

[57] ABSTRACT

An architectural element is formed from a frame and a body. The frame includes a nailing flange for adhering it to a surface such as a wall and an outwardly extending portion. The body, which substantially overlies the mounting frame, has an attachment portion for engaging the outwardly extending portion. The mounting frame and body are held together by an affixing part. In one embodiment, a recess is formed in the body and the affixing part includes a clip disposed within the recess. The clip resists movement of the body away from the mounting frame after their engagement. Resilient foam is disposed within a portion of the recess for forming a seal between the mounting frame and body. The body also includes an outwardly protruding portion which is designed to cover siding material that may overlie the nailing flange of the mounting frame.

24 Claims, 3 Drawing Sheets

38

22

10
12
14
16
18
20
22
24
26
28
30

ARCHITECTURAL ELEMENT FOR ATTACHING TO A STRUCTURE

FIELD OF THE INVENTION

This invention relates to an architectural element, such as a gable vent, which is mounted to a wall or other surface by the use of an attachment frame which interlocks with the element.

BACKGROUND OF THE INVENTION

Systems for mounting architectural elements such as vents to a wall or other surface of a building are known in the art. Typically, vents such as a gable vent are installed prior to the application of siding or other coverings on buildings, homes or other enclosures. The vent is usually nailed to a wall by means of an integral nailing flange on the vent. A covering material, typically siding, is then installed on the wall and the exposed ends of individual strips of siding overlie the nailing flange. After the siding is applied, a ring is snapped around the vent body to conceal the exposed ends. The exposed ends are typically cut so as to fit as close as possible to the side of the vent. This technique has the disadvantage in that it provides an inflexible system for covering the exposed ends of siding or covering material because only limited covering of the exposed ends can occur. This technique also limits the venting area for the enclosure. Present designs provide for covering several different discrete thicknesses of siding material but are not infinitely adjustable over a preset range.

One approach which allows for flexibility to accommodate different siding material thicknesses is described in U.S. Pat. No. 4,875318. This patent discloses a two-piece molded plastic vent product. The vent has a peripheral wall and an integral flange extending laterally outward from the peripheral wall for nailing the vent product to a wall of a building. A separate movable flange member, in the form of an annular ring, is telescoped over the peripheral wall. The separate flange member and the integral nailing flange form a pocket for receiving the ends of siding strips. The separate flange and the peripheral wall have interengaging detents at spaced intervals around the circumference of the peripheral wall, so that the separate flange can be positioned at different distances from the nailing flange to accommodate siding of different discrete thicknesses.

U.S. Pat. No. 4,407,100 discloses a two-part window frame assembly which can be mounted in a window opening in a body having a thickness within a predetermined range. A first frame part contains a flange and a barbed tongue portion (locking tongue). The flange is proportioned to bear against the edge of the body in which the window opening is formed. The second frame part contains a locking channel for engaging the tongue. During installation, the body is sandwiched between the two frame members and held together by the locking tongue. Since both frame parts are not disposed on the same side of the body or door 28, and the first frame part is not independently adhered to the surface of the body, installation is awkward and may require two people, one on each side of the body.

There is still a need for a vent or other architectural element for mounting to a wall or other surface which can accommodate siding of infinitely variable thicknesses over a given range, which completely covers all cut ends of the siding, eliminates the need for precise cutting of the siding prior to installation, is simple to install, simple to fabricate, and which provides a weathertight seal between the vent and the wall. The present invention fills that need.

SUMMARY OF THE INVENTION

The present invention provides an architectural product that can be mounted on the surface of a structure. The product is constructed from two main parts, a mounting frame and a body. The mounting frame includes a nailing flange for adhering it to a surface such as a wall and an outwardly extending portion. The body substantially overlies the mounting frame and has an attachment portion for engaging the outwardly extending portion. Means for affixing holds the mounting frame and body together.

In one embodiment, the means for affixing includes a recess formed in the body. A clip is disposed within the recess for resisting movement of the body away from the mounting frame after engagement. Resilient foam is disposed within a portion of the recess for forming a seal between the mounting frame and body. Additionally, the body includes an outwardly protruding portion which is designed to cover siding material that may overlie the nailing flange of the mounting frame.

The invention also provides a method for adhering a body to a wall. The body includes a recessed section having a first preset width. The recessed section is partially filled with resilient material and has at least one clip angularly projecting into it. The method provides for fastening a frame to a wall. The frame includes a planar section which lies flush against the wall, thereby providing a fastening surface, and a protruding section extending outward a preset distance from the planar section. After the frame is fastened to the wall, the recessed section of the body engages the protruding section of the frame portion. The body is then forced towards the wall so that the protruding section extends partially into the resilient material, thereby forming a seal between the frame portion and the body. The clip acts to resist movement of the body away from the frame.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is perspective elevational view of one preferred form of an architectural element such as a vent in accordance with the present invention installed on the gable of a building attic or the like.

DESCRIPTION OF THE PREFERRED EMBODIMENT

Figure 1:
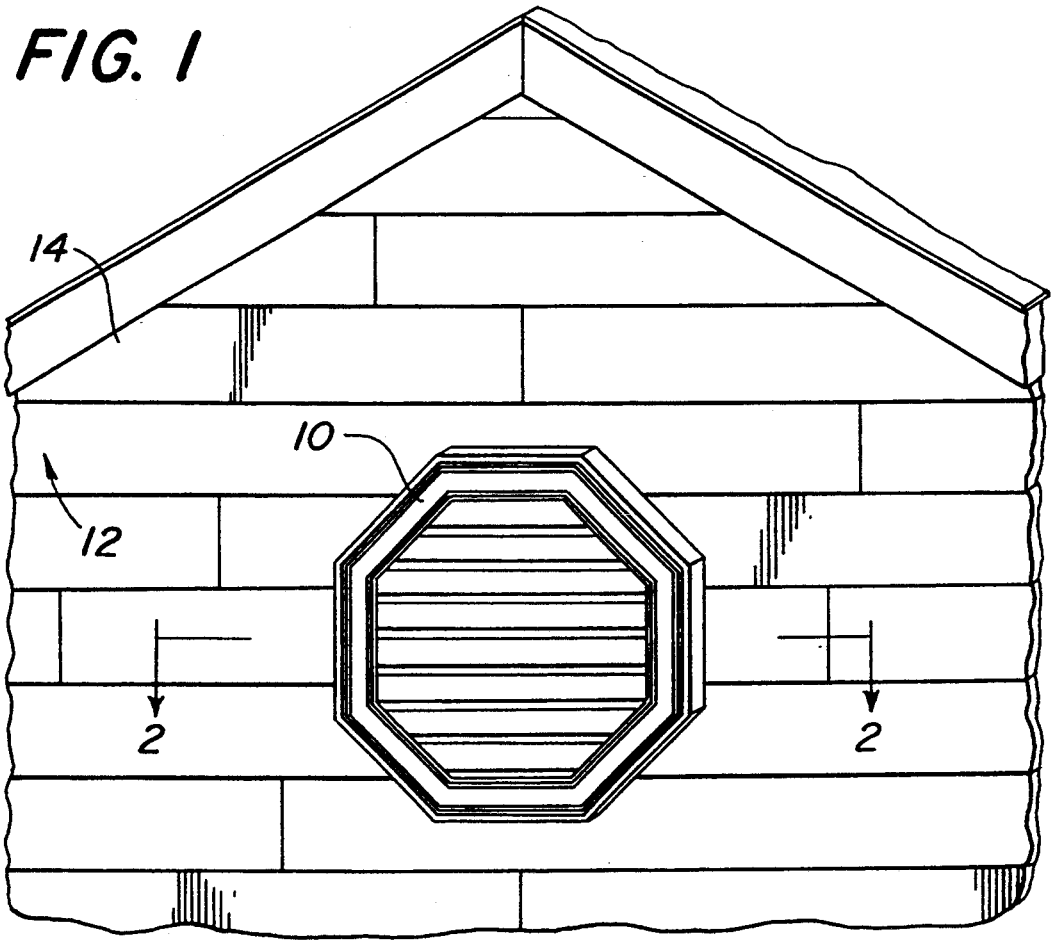

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Apparatus depicting the preferred embodiments of the novel system for mounting an architectural element to a wall or other surface by the use of a frame which interlocks with a recess formed in the architectural element are illustrated in the drawings.

Turning first to FIG. 1, an architectural element in the form of a vent body 10 is shown mounted to a wall 12. The wall 12 is typically covered with siding 14. The vent 10 completely covers all cut ends of the siding 14 in a manner depicted in subsequent figures and described below.

Figures 2, 4, 6:
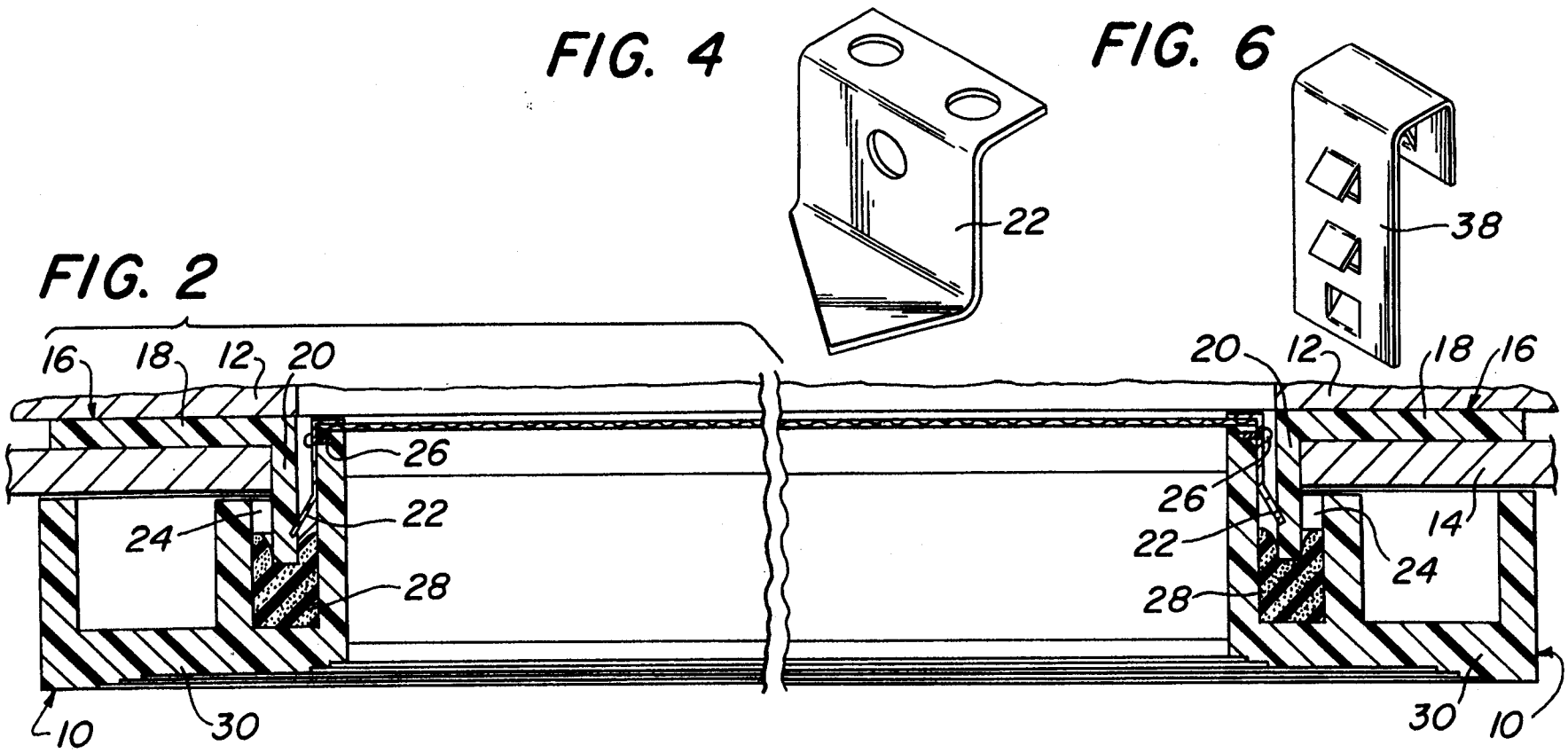
FIG. 2 is a sectional view of the vent and frame taken along axis line 2—2 in FIG. 1.
FIG. 4 is a separate view of a mounting clip for attachment to the vent which affixes the vent to the frame.
FIG. 6 is a separate view of the barbed clip illustrated in FIG. 5.

FIG. 2 shows a sectional view of a vent 10 and a frame 16 taken along axis line 2—2 in FIG. 1, and disposed in their final mounted positions. The frame 16 includes a nailing flange 18 which rests flush against wall 12 and extends outward from an opening (not numbered) in the wall which is to be covered. The frame 16 also includes a protruding portion 20 which extends outward from the wall. In the preferred embodiment, the protruding portion 20 extends outward perpendicularly from the wall 12. The vent 10 includes at least one clip 22 fastened to the inside of a recessed portion 24 by clip mounting screw 26. One portion of the clip 22 angularly protrudes into the recessed portion 24. The recessed portion 24 is partially filled with a resilient foam sealing material 28 which provides a weathertight seal between vent 10 and frame 16. The resilient material can be any closed or open cell foam substance. The vent 10 further includes a portion 30 extending outwardly from the recessed portion 24. This portion is L-shaped when viewed in section, as depicted in FIG. 2. One part of the L-shaped portion 30 runs parallel to the wall for a preset distance sufficient to completely covers all cut ends of the siding 14. The other part of the L-shaped portion 30 preferably runs perpendicularly towards the wall for a distance so as to end at a given distance from the outwardly facing surface of the nailing flange 18. Although FIG. 2 shows the siding 14 flush against the protruding portion 20 of frame 16, rough cutting of pieces of siding will probably not result in such a tight fit. As long as the cut edge of the siding is close enough to the protruding portion 20 so that it is covered by the parallel L-shaped part of portion 30 of the vent, the rough cut edge will be hidden from a frontal view of the wall 12 by the part of portion 30 that runs perpendicularly towards the wall.

During installation, the frame 16 is mounted to the wall 12 (typically unfinished at this stage) in a manner depicted in FIG. 3, described below. If the desired hole in the wall is not already cut out, the inside diameter of the frame 16 will define the area to be cut by the use of a saw. router or other appropriate tool. After the frame 16 is mounted siding 14 is attached to the wall. Rough cut edges of the siding 14 overlie portions of the nailing flange 18. Vent 10 is then gently forced towards the frame 16. The recessed portion 24 of vent 10 engages the protruding portion 20 of the frame 16. As the vent 10 continues to be gently forced towards the wall, resilient foam sealing material 28 compresses to allow for engagement of the protruding portion 20. The vent 10 will eventually engage siding 14 which will prevent it from being pushed any closer to the wall 12. If the wall remains unfinished, the vent will eventually engage frame 16 and will, likewise, be prevented from being pushed any closer to the wall 12. The clip 22, in combination with the recession of the protruding portion 20 of the frame 16 into the sealing material 28 will act to resist movement of vent 10 away from wall 12. Note that the vent 10 and frame 16 are both fully disposed on the same surface of the wall 12, thereby simplifying installation.

Figure 3:
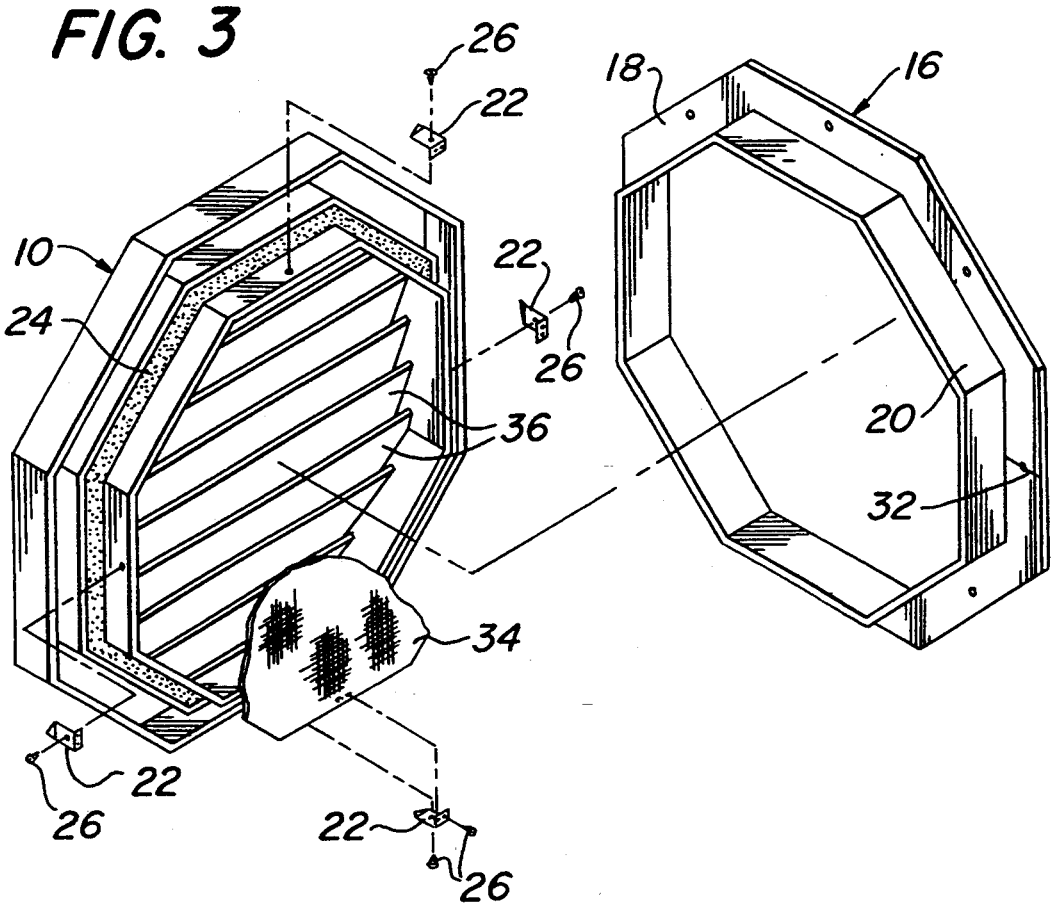
FIG. 3 is an exploded isometric view of the vent and frame.

FIG. 3 shows an exploded isometric view of how an architectural element in the form of a screened, louvered vent body 10 is mounted to a wall. A plurality of holes disposed along the nailing flange 18 of a frame 16 allow the frame to be fastened to the wall. Leveling line 32 ensures proper orientation of non-circular vent 10. A plurality of clips 22 are fastened to an inside wall of the recessed portion 24 (shown partially filled with resilient material) of vent 10 by clip mounting screws 26. Some of the screws also fasten screen 34 to the inner side of vent 10. A series of parallel individual louvers 36, with ventilation slots between adjacent louvers, are permanently fixed within the circumference of vent 10. As described above, when vent 10 is gently forced towards the frame 16, the recessed portion 24 of the vent 10 engages the protruding portion 20 of the frame 16.

FIG. 4 shows an enlarged view of clip 22 used in FIG. 2, described above.

Figure 5:
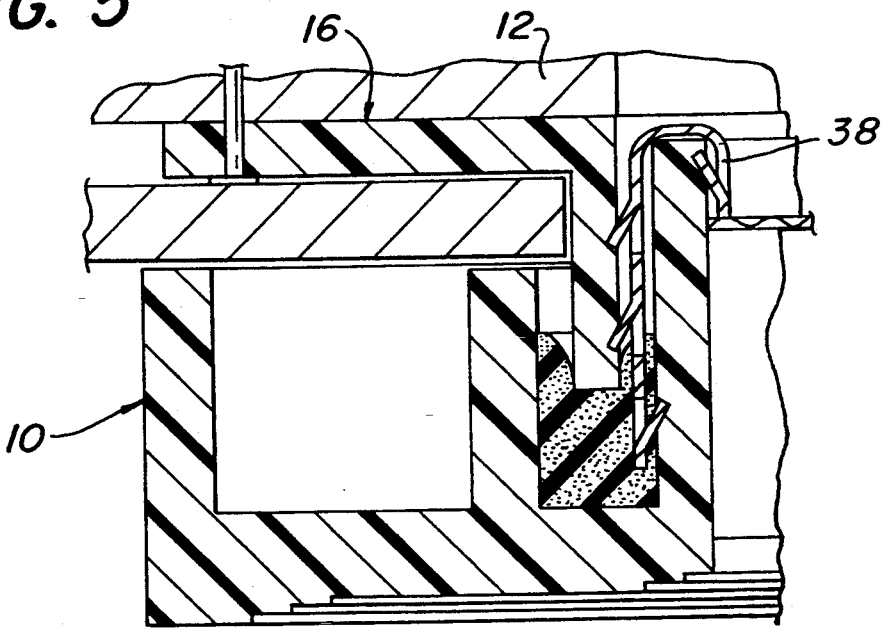
FIG. 5 is an enlarged fragmentary view of the vent and frame in their final mounted position. This view is similar to FIG. 2 but shows the use of a barbed clip for affixing the vent to the frame.

FIG. 5 shows an enlarged fragmentary view of vent 10 and frame 16 in their final mounted position, but held together by barbed clip 38, instead of clip 22. The barbed clip 38 wraps around the outer wall of the vent body's recess. In the preferred embodiment, two barbs project into the outer wall of the vent body's recess and act to fasten the barbed clip 38 to vent 10. One barb is disposed on the inside of the recess and one is disposed on the outside of the recess. In the preferred embodiment, two additional barbs project into the recess and serve to resist movement of vent 10 away from wall 12 in a manner similar to clip 22.

FIG. 6 shows an enlarged view of barbed clip 38 used in FIG. 5, described above.

Figure 7:
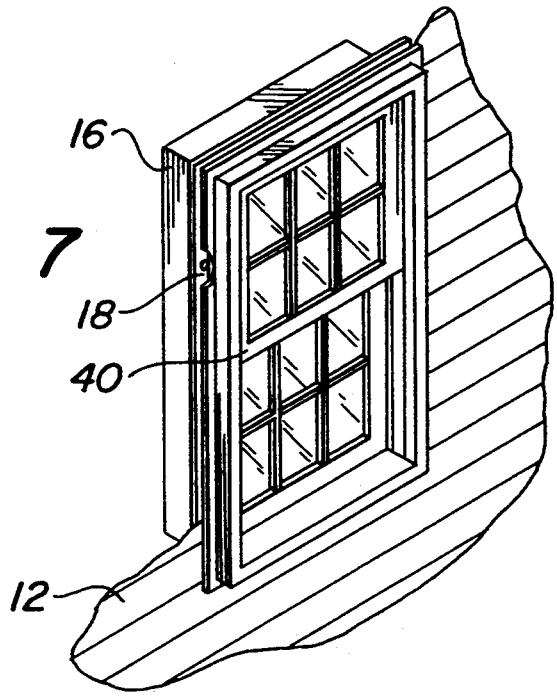
FIG. 7 is a perspective view of an alternative form of an architectural element in accordance with the invention, in the form of a window frame installed in a wall.

FIG. 7 shows a perspective view of an alternative form of an architectural element in the form of a window frame 40 installed inside a wall 12. A nailing flange 18 is formed on the outer edge of frame 16 and is partially visible through the cutout portion the window frame 40. The frame 16 also has a protruding portion 20 which is hidden from view by the architectural element.

Although the preferred embodiments show the use of the invention for fastening a gable vent and window frame to a wall, it should be understood that the invention is adaptable for fastening any type of architectural element of any shape to a wall. Also, the frame 16 need not be a ring or closed form if a completely weathertight seal is not needed. For example, the frame need only extend partially around the periphery of the architectural element. The architectural element also need not be a ring or closed form. For example, it may be desired to frame around a crescent-shaped piece of glass disposed above a rectangular pane of glass. In this instance, only an upper half portion of a frame and architectural element would be needed.

It should also be understood that the protruding portion 20 of the frame may be disposed on the architectural element and the recessed portion 24 may be disposed on the frame, opposite of the depicted configuration. The interaction of the two parts would, otherwise, be the same as described.

Clip 22 and barbed clip 38 can also be constructed so that the part which extends into the recessed portion 24 bends slightly towards the inner wall in which it is fastened to. In this manner, the compression of the clip against the projecting portion of frame 16 will further serve to resist movement of the mounted architectural element away from the wall. The optimal number of clips employed around the circumference of the architectural element will depend upon the particulars of the type of element to be mounted. Also, instead of physical clips or barbs, a flange or similar structure on the protruding portion 20 could glide over pliable angled teeth formed on an inner wall of the recessed portion 24. These teeth would then serve to resist movement of the architectural element away from the wall.

It should be appreciated that the combination of the architectural element (formed with the features depicted in vent 10) and frame 16 allows for an infinite number of thicknesses of siding material, within a given range, to be accommodated. The fabrication of the necessary parts and the installation procedure are both simple. The final result is a weathertight sealed architectural element which completely covers all rough cut ends of siding, thereby providing a neat, clean appearance to the wall.

The present invention may be embodied in other specific forms without departing from the spirit or essential attributes thereof and, accordingly, reference should be made to the appended claims, rather than to the foregoing specification, as indicating the scope of the invention.

We claim:

1. An architectural product for mounting on a surface of a structure, comprising:

mounting frame means having (a) a first portion disposed in a plane, the first portion adapted to contact a surface of a structure and lie substantially flush with the surface of the structure so that the mounting frame means may be adhered to said surface, and (b) a second portion extending outwardly away from the plane of the first portion by a preselected distance and having an outer surface generally coplanar with the first portion;

body means attachable to the mounting frame means, the body means substantially covering the mounting frame means, including the outer surface, the body means having an attachment portion adapted to engage the mounting frame means second portion; and means for affixing the body means attachment portion to the mounting frame means second portion.

2. An architectural product as recited in claim 1, wherein said attachment portion includes a recess and said mounting frame means second portion engages said recess, and wherein said means for affixing comprises at least one clip angularly projecting into the recess, said clip acting to resist movement of said body means away from said mounting frame means after engagement thereof.

3. An architectural product as recited in claim 2, wherein said mounting frame means and said body means each have a circumference, said mounting frame means second portion extends along the entire circumference of said mounting frame means and wherein said recess is formed along the entire circumference of said body means.

4. An architectural product as recited in claim 2, further including resilient material means disposed within said recess for forming a seal between said body means and said mounting frame means, wherein said mounting frame means second portion extends partially into said resilient material means.

5. An architectural product as recited in claim 4 wherein said resilient material includes a closed cell foam substance.

6. An architectural product as recited in claim 4 wherein said resilient material includes an open cell foam substance.

7. An architectural product as recited in claim 2, wherein said clip includes two barbs extending into said body means, one barb disposed into an inner wall of said recess and another barb extending into an outer wall of said recess, said barbs serving to affix said clip to said body means.

8. An architectural product as recited in claim 1, wherein said body means further includes a covering portion extending outward from and adjoined to said attachment portion, said covering portion hiding said mounting frame means second portion and at least a part of said mounting frame means first portion while viewing a fully assembled and mounted architectural product.

9. An architectural product as recited in claim 8 wherein said covering portion comprises a first straight portion parallel to said first portion and a second straight portion at an angle to said first straight portion and oriented towards said first portion so as to end at a given distance from said first portion.

10. An architectural product as recited in claim 9 wherein siding material overlies said mounting frame means first portion and wherein said given distance is approximately the width of the siding material.

11. An architectural product as recited in claim 1 further including vent means for allowing air to pass through said body means, said vent means being rigidly attached to said body means and covering the area bounded by said body means.

12. A multi-part system for adhering a body to a frame portion, the system comprising:

a frame portion including (a) a framing section disposed in a plane and having a surface for fastening the frame portion to the wall, the framing section adapted to lie flush against a wall, and (b) a protruding section extending outwardly away from the surface of the framing section by a preselected distance, the protruding section having a first preselected width;

a body including a recessed section having a second preselected width adapted to engage the protruding section and an outer section attached to the recessed section adapted to extend over at least a part of the framing section so as to hide the protruding section and at least a part of the framing section when viewing a fully assembled and adhered system, wherein the width of the recessed section is greater than the width of the protruding section;

resilient material disposed within the recessed section adapted to form a seal between the frame portion and the body, the protruding section extending partially into the resilient material; and at least one clip including a fastening portion adapted to adhere the clip to the body and at least one angularly projecting portion extending into the recessed section, the clip acting to resist movement of the body away from the frame portion when the body is mounted to the frame portion.

13. The system of claim 12 wherein said framing section and said body each have a circumference, the protruding section extends outwardly along the entire circumference of the framing section and the recessed section is formed along the entire circumference of the body.

14. The system of claim 12 wherein the protruding section extends perpendicularly from the framing section.

15. The system of claim 12 further including a vent portion rigidly attached to the body, the vent portion covering the area bounded by the frame portion.

16. The system of claim 12 wherein the fastening portion of the clip is adhered to the inner wall of the recessed section.

17. The system of claim 12 wherein the fastening portion of the clip includes two barbs extending into the body, one barb disposed into the inner wall of the recessed section and another barb extending into the outer wall of the recessed section.

18. The system of claim 12 wherein the resilient material includes a closed cell foam substance.

19. The system of claim 12 wherein the resilient material includes an open cell foam substance.

20. The system of claim 12 wherein the outer section comprises a first straight portion parallel to the framing section and a second straight portion at an angle to said first straight portion and oriented towards the framing section so as to end at a given distance from the outwardly facing surface of the framing section.

21. The system of claim 20 wherein siding material overlies the framing section and wherein the given distance is approximately the width of siding material.

22. The system of claim 12 wherein the recessed section has an inner wall and the clip's projecting portion bends towards the inner wall of the recessed section as the protruding section of the frame portion engages the recessed section, the compression of the projecting portion further acting to resist movement of the body away from the frame portion.

23. A method for adhering a body to a wall, a body including a recessed section, the recessed section having a first preselected width and being partially filled with resilient material and having at least one clip means angularly projecting therein, the method comprising the steps of:

(a) fastening a frame portion to a wall, the frame portion including a framing section disposed in a plane and having a surface for fastening the frame portion to the wall, the framing section adapted to lie flush against the wall, and a protruding section extending outwardly away from the surface a preselected distance from the framing section and having a second preselected width smaller than the first preselected width;

(b) engaging the recessed section of the body with the protruding section of the frame portion; and (c) forcing the body towards the wall so that the protruding section extends partially into the resilient material, thereby forming a seal between the frame portion and the body, wherein the clip means acts to resist movement of the body away from the frame portion.

24. The method of claim 23, wherein the body further includes an outer section and wherein siding material overlies the framing section, further including the step of:

(d) continuing to urge the body towards the wall until the outer section touches the siding, the outer section covering the portion of the siding overlying the framing section.

* * * * *